US010351292B2

(12) United States Patent
Wishon

(10) Patent No.: US 10,351,292 B2
(45) Date of Patent: Jul. 16, 2019

(54) BOX WITH CLOSEABLE APERTURE

(71) Applicant: Nautilus, Inc., Vancouver, WA (US)

(72) Inventor: Christopher R. Wishon, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 15/233,611

(22) Filed: Aug. 10, 2016

(65) Prior Publication Data

US 2018/0044052 A1 Feb. 15, 2018

(51) Int. Cl.
*B65D 5/42* (2006.01)

(52) U.S. Cl.
CPC ..... *B65D 5/4204* (2013.01); *B65D 5/4237* (2013.01); *B65D 2585/649* (2013.01)

(58) Field of Classification Search
CPC ..... B65D 5/4204; B65D 25/54; B65D 2571/0045
USPC .... 229/122, 117.13, 117.16, 120.08, 120.14, 229/120.15, 120.18, 120.37, 120.02; 206/779, 38, 38.1, 223; 220/501, 503, 220/505, 523, 23.83, 23.86, 23.87, 23.2, 220/23.4, 524, 529; 383/38, 39, 40
See application file for complete search history.

(56) References Cited

U.S. PATENT DOCUMENTS

| | | | | |
|---|---|---|---|---|
| 4,163,494 | A * | 8/1979 | Stollberg | B65D 85/505 206/423 |
| 4,331,235 | A * | 5/1982 | Brundage | B65D 5/4295 206/423 |
| 6,640,813 | B2 * | 11/2003 | Raisner | A45C 11/008 132/200 |
| 8,348,087 | B2 * | 1/2013 | Sawaki | B65D 81/3855 220/23.86 |
| 8,517,202 | B1 * | 8/2013 | Lord | B65D 5/4804 220/23.87 |
| 8,905,240 | B2 * | 12/2014 | Park | A45D 29/18 206/581 |
| 2007/0223843 | A1 * | 9/2007 | Frohwein | A45C 11/20 383/38 |
| 2013/0043241 | A1 * | 2/2013 | Hunter | B65D 25/005 220/6 |
| 2014/0175101 | A1 * | 6/2014 | Dixon | B65D 5/6661 220/529 |
| 2014/0183071 | A1 * | 7/2014 | Smith, III | B65D 5/4204 206/278 |

* cited by examiner

*Primary Examiner* — Christopher R Demeree
(74) *Attorney, Agent, or Firm* — Dorsey & Whitney LLP

(57) ABSTRACT

A box with a closeable aperture and a method of accessing an interior of a box are provided. The box may include a sidewall and a flap formed in the sidewall. The flap may be repositionable relative to the sidewall to selectively open and close an aperture formed in the sidewall. The flap may include a main body and a tab, and the tab may be repositionable relative to the main body of the flap for grasping by a user. The method may include pivoting a flap formed in a sidewall of the box relative to the sidewall to provide access to an aperture in the sidewall, pivoting a tab of the flap relative to a main body of the flap, and grasping the tab to reposition the flap relative to the sidewall.

20 Claims, 6 Drawing Sheets

BOX WITH CLOSEABLE APERTURE

TECHNICAL FIELD

The present disclosure relates generally to shipping containers and more specifically to a box with a closeable aperture.

BACKGROUND

Various sizes and configurations of boxes exist to ship a variety of products, such as fitness equipment. Some boxes include a flap formed in a sidewall of the box for permitting a handler to move the flap and insert their hand into an aperture in the sidewall previously occupied by the flap to provide a handhold for carrying the box. The flap generally is pushed inwardly into the interior of the box. Once pushed into the interior of the box, the flap remains in this position during shipping and no longer closes the aperture in the sidewall of the box, thereby exposing the product inside the box to the exterior environment. Additionally or alternatively, documents placed inside the box, such as owner manuals and/or shipping information, may exit the box through the aperture and thus may be lost during shipping. Similarly, smaller components placed inside the box may be lost during shipping.

It is therefore desirable to provide an improved box that addresses at least in part the above described problems and/or which more generally offers improvements or an alternative to existing arrangements.

SUMMARY

The present disclosure generally provides a box with a closeable aperture. The box may include a flap that is pivotable into an interior of the box or outwardly away from a sidewall of the box depending on user preference. Once the flap is pivoted out-of-plane of a respective sidewall of the box, a user may insert one or more documents (e.g., product manuals, shipping information, etc.), components (e.g., spare parts, batteries, etc.), and/or other items into the box after the product is packaged for shipping. The flap may pivot about a living hinge formed in the sidewall of the box. The flap may include a tab that is foldable relative to a main body portion of the flap for easy gripping by the user. The user may grasp the tab and position the flap in plane with the sidewall to close the aperture in the sidewall. The flap may be secured in this position, such as taped in position, to ensure the flap remains in the closed position during transport.

Embodiments of the present disclosure may include a box with a closeable aperture. The box may include a sidewall and a flap formed in the sidewall. The flap may be repositionable relative to the sidewall to selectively open and close an aperture formed in the sidewall. The flap may include a main body and a tab. The tab may be repositionable relative to the main body of the flap for grasping by a user.

Embodiments of the present disclosure may include a method of accessing an interior of a box. The method may include pivoting a flap formed in a sidewall of the box relative to the sidewall to provide access to an aperture formed in the sidewall. The method may further include pivoting a tab of the flap relative to a main body of the flap. The method may further include grasping the tab to reposition the flap relative to the sidewall.

Additional embodiments and features are set forth in part in the description that follows, and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
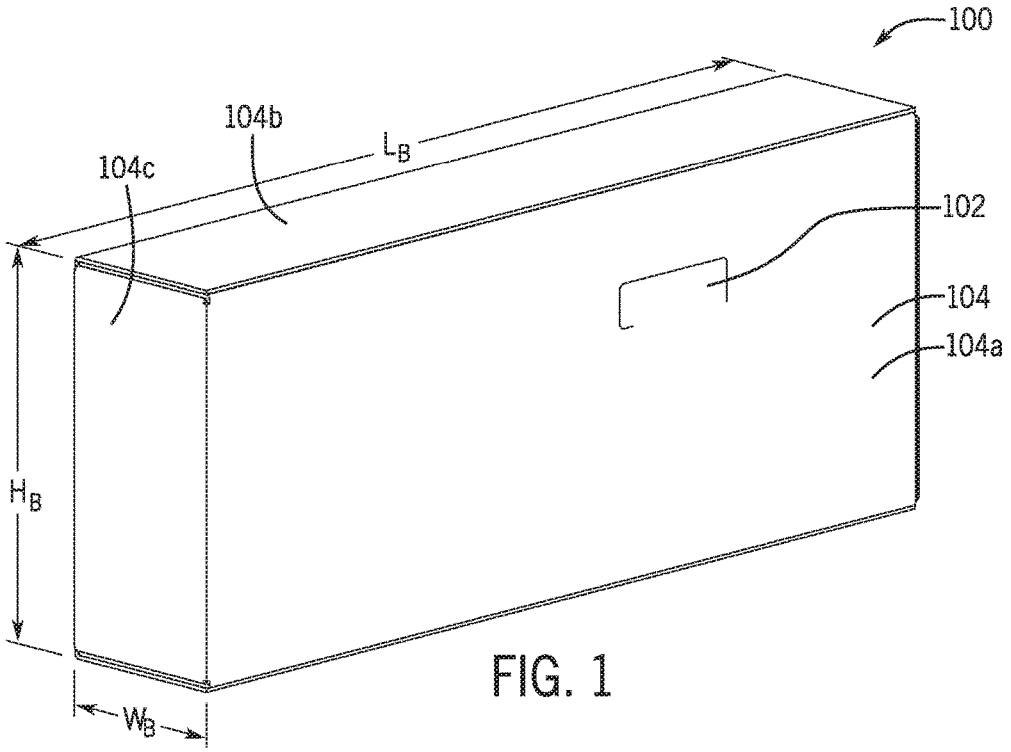
FIG. 1 is a top isometric view of a box with a repositionable flap formed in a sidewall of the box.
Figure 13:
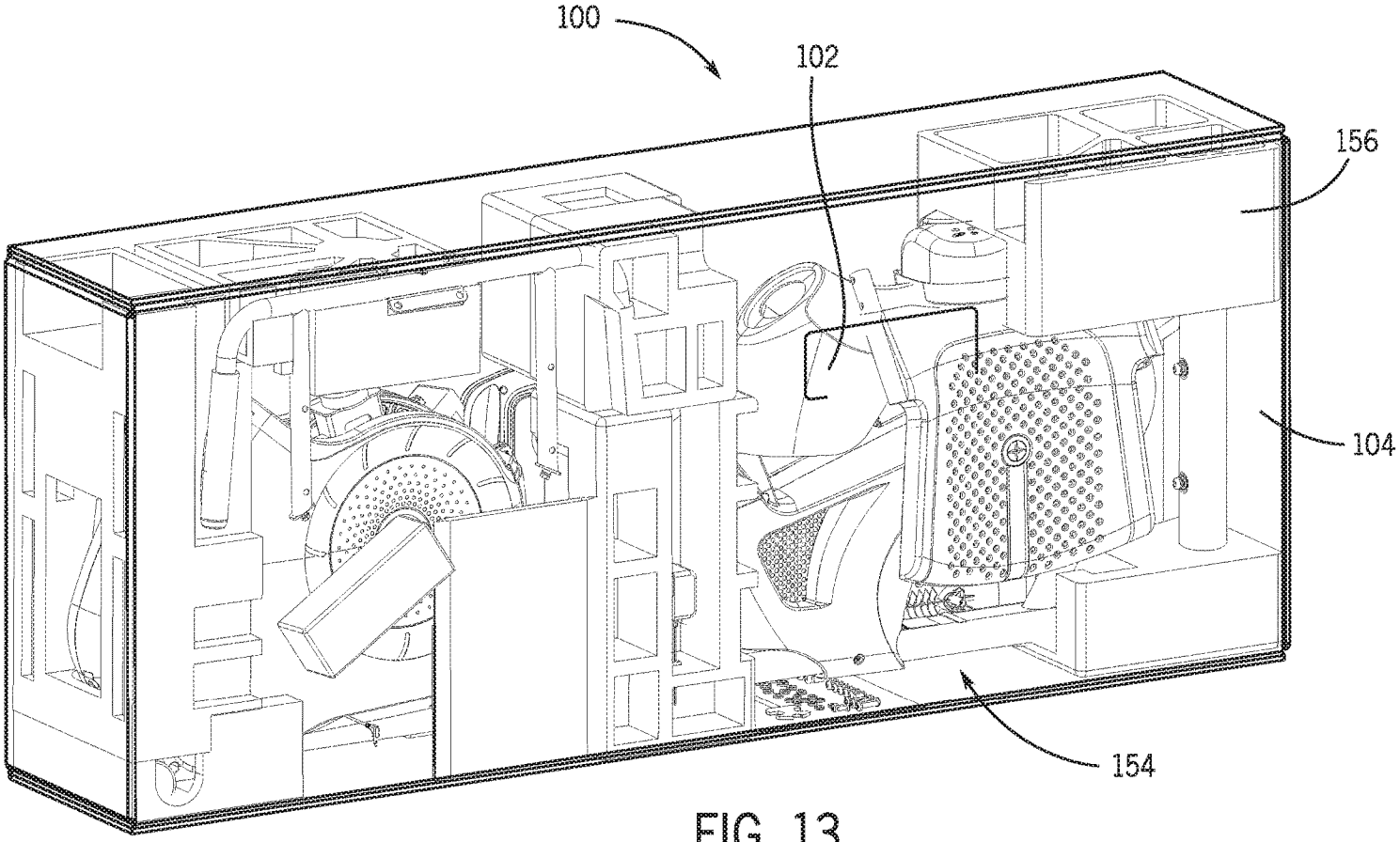
FIG. 13 is a top isometric view of the box of FIG. 1 with fitness equipment packaged inside the box for shipping.
Figure 14:
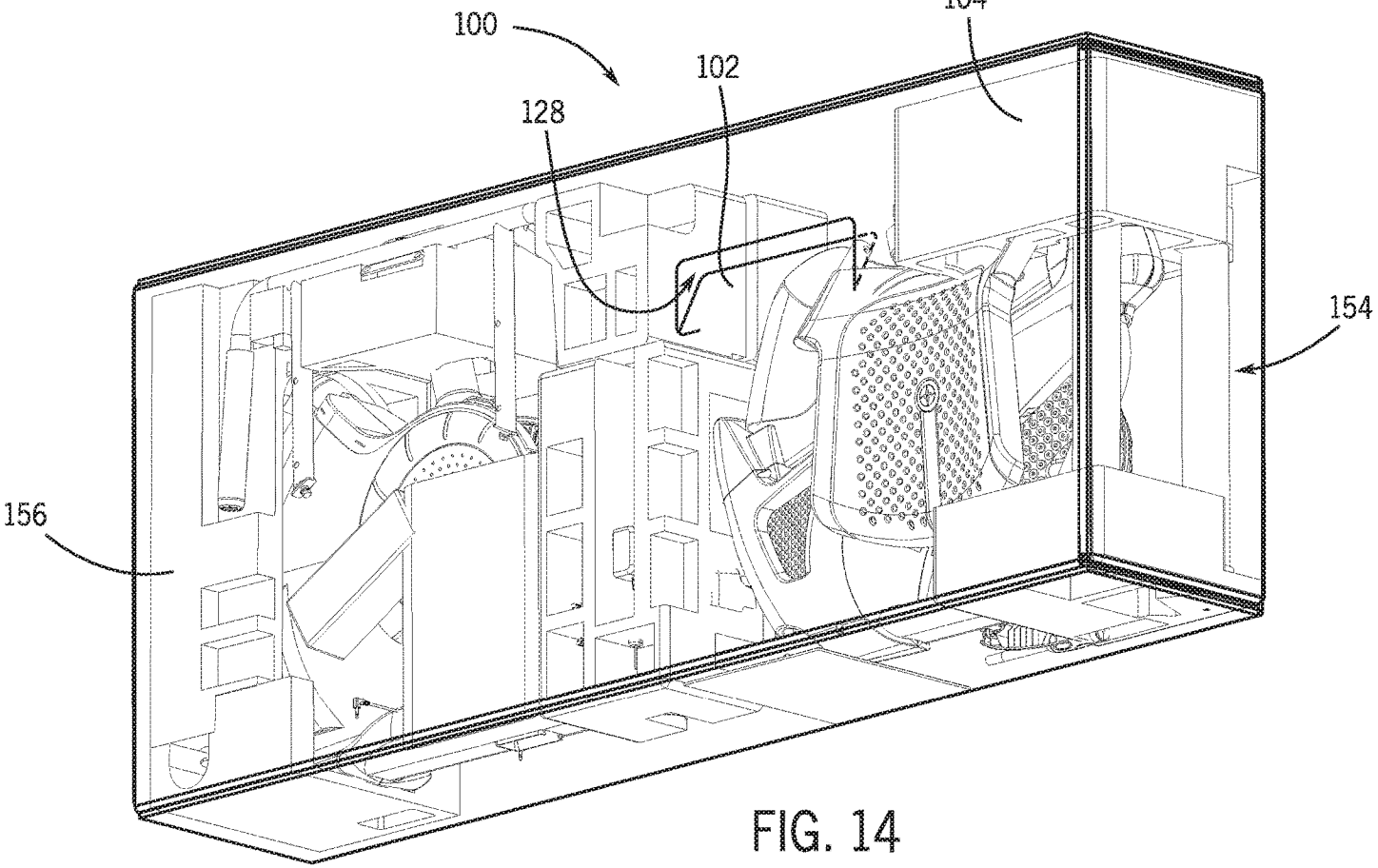
FIG. 14 is a bottom isometric view of the box of FIG. 1 with fitness equipment packaged inside the box for shipping.

FIGS. 1-14 illustrate an embodiment of a box 100. The box 100 may be formed in various shapes and sizes. As illustrated in FIG. 1, the box 100 may be formed as a rectangular cuboid, or any other shape suitable for shipping contents within the box 100. The box 100 may include a height $H_B$, a length $L_B$, and a width $W_B$. The height $H_B$, length $L_B$, and width $W_B$ may vary depending on the size of the contents to be shipped. As illustrated in FIGS. 13 and 14, the box 100 may be sized to accommodate fitness equipment, such as a treadmill, an upright bike, a recumbent machine, an elliptical machine, or other fitness equipment. A representative box for a treadmill may include a height $H_B$ of about thirteen inches, a length $L_B$ of about seventy-eight inches, and a width $W_B$ of about thirty inches. A representative box for an upright bike may include a height $H_B$ of about twenty-three inches, a length $L_B$ of about forty-one inches, and a width $W_B$ of about thirteen inches. A representative box for a recumbent machine may include a height $H_B$ of about twenty-seven inches, a length $L_B$ of about sixty-seven inches, and a width $W_B$ of about thirteen inches. A representative box for an elliptical machine may include a height $H_B$ of about thirty-four inches, a length $L_B$ of about fifty-one inches, and a width $W_B$ of about twenty-two inches. These dimensions are provided as examples of various box sizes, and other sizes are contemplated.

Figure 2:
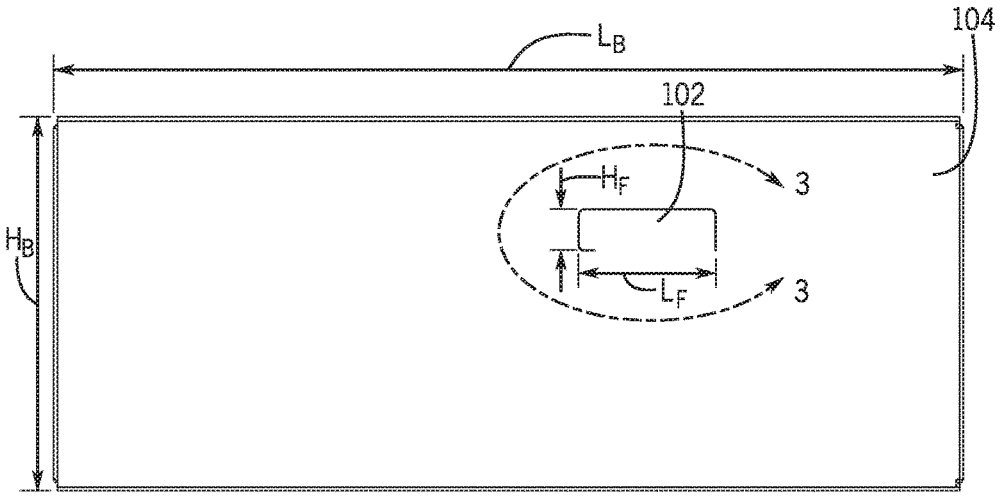
FIG. 2 is a front elevation view of the sidewall including the flap illustrated in FIG. 1.

The box 100 illustrated in FIG. 1 includes six sidewalls 104, and three of the sidewalls are in view. Referring to FIGS. 1 and 2, a flap 102 may be formed in any of the sidewalls 104, and the location of the flap 102 may depend on the contents of the box 100 and the particular arrangement of the contents within the box 100. For example, the flap 102 may be defined in the sidewall 104 at a location that corresponds to an empty space or void inside the box 100 (see, e.g., FIGS. 13 and 14) such that one or more items, such as documents (e.g., product manuals, shipping information, etc.), components (e.g., spare parts, batteries, etc.), and/or other items may be inserted into the box after the product is packaged for shipping. In the illustrative embodiment of FIGS. 1 and 2, the flap 102 is formed in a major sidewall 104*a* of the box 100. Additionally or alternatively, the flap 102 may be formed in a different sidewall, such as minor sidewall 104*b* or 104*c* of the box 100. Although a single flap is illustrated in FIG. 1, the box 100 may include multiple flaps, which may be the same or different sizes.

Figure 3:
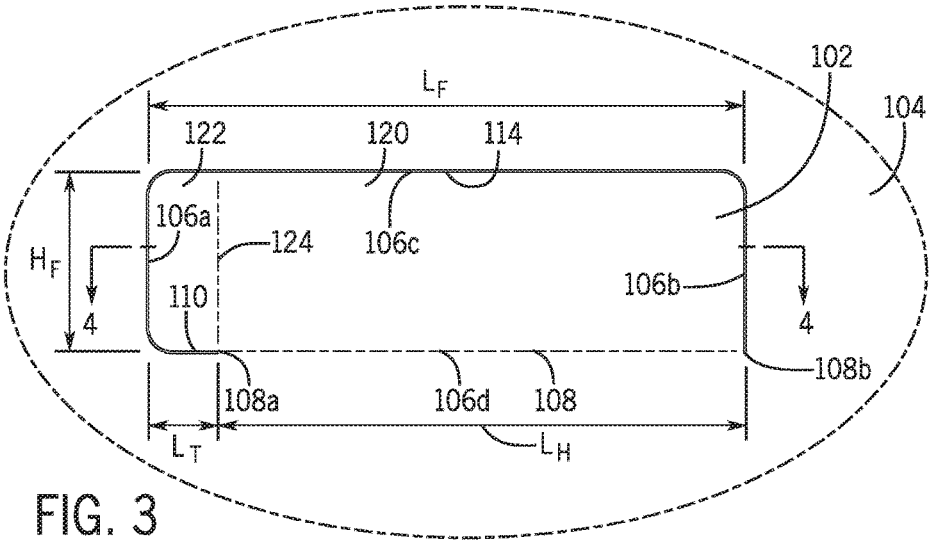
FIG. 3 is an enlarged view of the flap illustrated in FIG. 1 taken along line 3-3 in FIG. 2.

Referring still to FIGS. 1 and 2, the flap 102 may occupy a percentage of the area of the sidewall 104 of the box 100. The flap 102 may be formed in various shapes and sizes to accommodate various items to be inserted into an interior of the box 100 after the product is packaged in the box 100 for shipping. In the illustrative embodiment of FIGS. 1 and 2, the flap 102 is formed in a rectangular shape, but other polygonal and non-polygonal shapes are contemplated. Referring to FIG. 3, the flap 102 may include a length $L_F$ defined between opposing side edges 106*a*, 106*b*, and a height $H_F$ defined between opposing top and bottom edges 106*c*, 106*d*. The flap 102 may be oriented such that its length $L_F$ extends along the length $L_B$ of the box 100 and its height $H_F$ extends along the height $H_B$ of the box 100. The length $L_F$ of the flap 102 may be a percentage of the length $L_B$ of the box 100, and the height $H_F$ of the flap 102 may be a percentage of the height $H_B$ of the box 100. For example, the length $L_F$ of the flap 102 may be about fifteen percent of the length $L_B$, and the height $H_F$ of the flap 102 may be about ten percent of the height $H_B$ of the box 100. These percentages are provided as examples, and other percentages are contemplated. In some embodiments, the flap 102 includes a length $L_F$ of about ten inches and a height $H_F$ of between about two and three inches. The size of the flap 102 may vary depending on the shipping application and the size of the items to be inserted into the box 100.

The flap 102 may be repositionable relative to the sidewall 104 to selectively open and close an aperture formed in the sidewall 104 (see, e.g., aperture 128 in FIGS. 5, 7, 8, 10, and 14). Similar to the flap 102, the aperture may include different form factors (e.g., height greater than length, etc.). Referring to FIG. 3, the flap 102 may be pivotally connected to the sidewall 104. For example, the flap 102 may be connected to the sidewall 104 along a first living hinge 108 extending along an edge, such as bottom edge 106*d*, of the flap 102. The flap 102 may pivot about the first living hinge 108 formed in the sidewall 104 between a closed position in which the flap 102 is in plane with the sidewall 104 (see, e.g., FIGS. 1, 3, 4, and 9) and an open position in which the flap 102 is non-planar with the sidewall 104 (see, e.g., FIGS. 7 and 10). In a first open position, the flap 102 may be pivoted outwardly away from the sidewall 104 (see, e.g., FIGS. 7 and 8). In a second open position, the flap 102 may be pivoted inwardly away from the sidewall 104 and into an interior of the box 100 (see, e.g., FIGS. 10 and 11). The first living hinge 108 may be scored to facilitate pivoting of the flap 102 relative to the sidewall 104.

With continued reference to FIG. 3, the flap 102 may be separated from the sidewall 104 along a periphery 114 of the flap 102. For example, a cut line may be formed in the sidewall 104 along the periphery 114 of the flap 102 to define a line of separation of the flap 102 from the sidewall 104, with the first living hinge 108 connecting the flap 102 to the sidewall 104. The periphery 114 of the flap 102 may terminate at first and second ends 108*a*, 108*b* of the first living hinge 108. The bottom edge 106*d* of the flap 102 may extend the full length $L_F$ of the flap 102 and may be longer than the length $L_H$ of the first living hinge 108. For example, the line of separation may extend around the periphery edges 106*a*-106*c* of the flap 102, and further extend along a portion of the bottom edge 106*d*.

As illustrated in FIG. 3, a tab 122 may be formed in the flap 102. To form the tab 122, an end portion 110 of the bottom edge 106*d* of the flap 102 may be separated from the sidewall 104, as noted above, and the tab 102 may be folded about a second living hinge 124. The length $L_T$ of the end portion 110 plus the length $L_H$ of the first living hinge 108 may be equal to the length $L_F$ of the bottom edge 106*d* of the flap 102. In FIG. 3, the tab 122 forms a left end portion of the flap 102, but the tab 122 may be formed along other portions of the flap 102 as further described below. In some embodiments, the tab 122 includes a length $L_T$ of about one inch. The length $L_T$ of the tab 122 may vary depending on the shipping application.

Referring to FIGS. 3-7, 10, and 11, the flap 102 may include a main body 120 adjacent to (e.g., contiguous with) the tab 122. The tab 122 may be repositionable relative to the main body 120 for grasping by a user. Referring to FIG. 3, the tab 122 may be pivotally attached to the main body 120 by the second living hinge 124, which may be positioned between the tab 122 and the main body 120. The main body 120 and the tab 122 may be generally planar in some configurations.

Referring to FIGS. 5-7, 10 and 11, the tab 122 may be pivoted about the second living hinge 124 formed in the flap 102 between a first position in which the tab 122 is in plane with the main body 120 (see, e.g., FIGS. 3 and 4) and a second position in which the tab 122 is non-planar with the main body 120 (see, e.g., FIGS. 5-7, 10, and 11). When the tab 122 is in the first position, the flap 102 may be positioned in plane with the sidewall 104 to close the aperture (see, e.g., FIGS. 1-4, 9, 12, and 13). When the tab 122 is in the second position, the tab 122 may at least partially open the aperture 128 (see, e.g., FIGS. 5 and 6).

Figure 5:
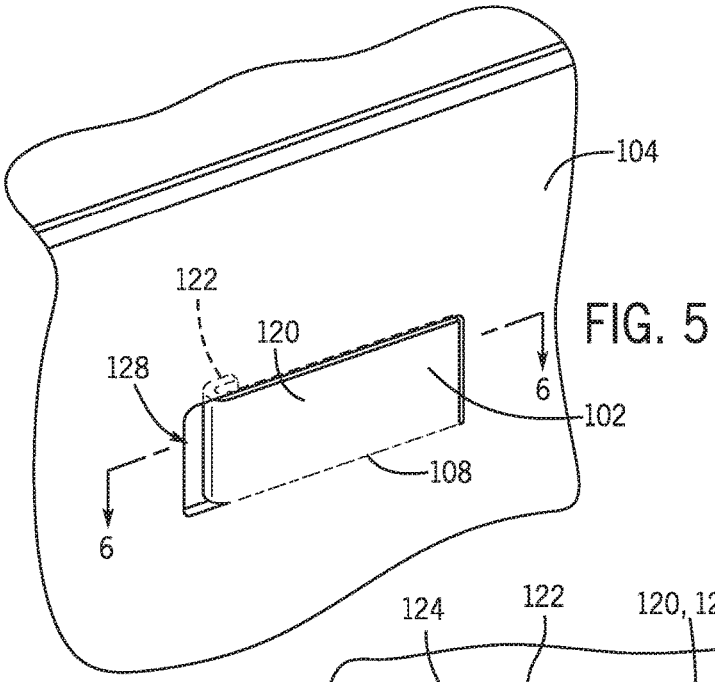
FIG. 5 is a fragmentary isometric view of the box of FIG. 1 with a tab folded inwardly relative to a main body of the flap for grasping by a user.
Figure 6:
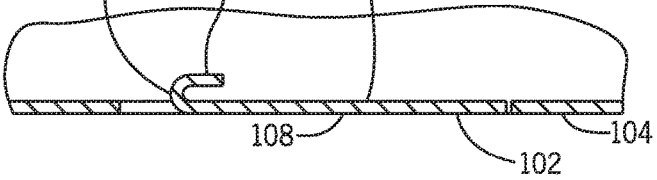
FIG. 6 is a sectional view of the box illustrated in FIG. 5 taken along line 6-6 in FIG. 5.
Figure 10:
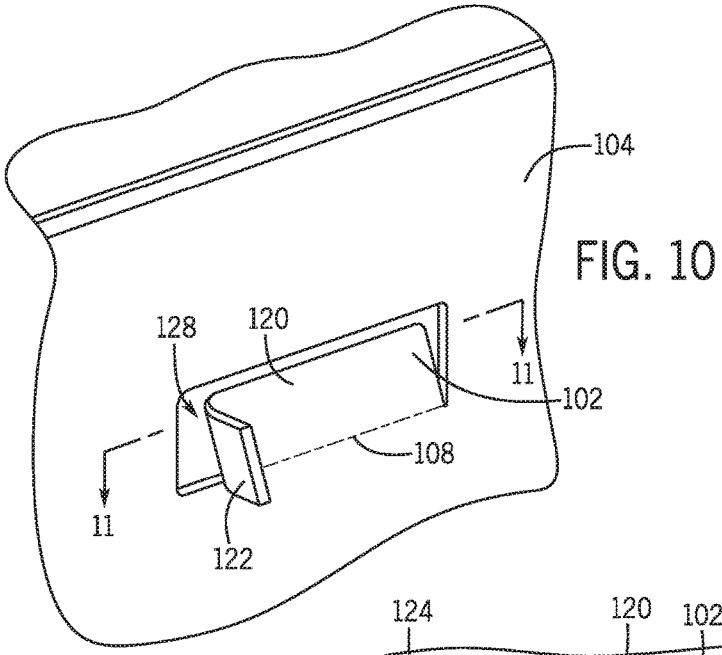
FIG. 10 is a fragmentary isometric view of the box of FIG. 1 with the flap pivoted inwardly into an interior of the box and a tab folded outwardly relative to a main body of the flap for grasping by a user.
Figure 11:
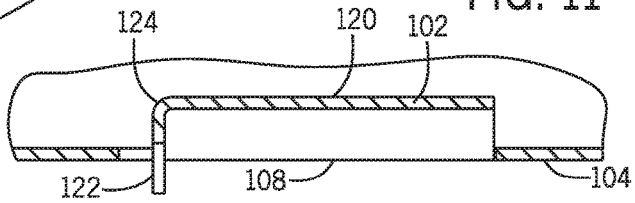
FIG. 11 is a sectional view of the box illustrated in FIG. 10 taken along line 11-11 in FIG. 10.

Referring to FIGS. 5-7, 10, and 11, the tab 122 may be folded relative to the main body 120 of the flap 102 such that a user may grasp the tab 122 to move the flap 102 relative to the sidewall 104. For example, the tab 122 may be folded inwardly or outwardly relative to the main body 120 of the flap 102 to facilitate movement of the flap 102. As shown in FIGS. 5 and 6, the tab 122 may be folded inwardly relative to the main body 120 of the flap 102 such that a user may insert a portion of their hand (e.g., one or more fingers) through a portion of the aperture 128 and grasp a portion of the flap 102 (such as the tab 122 and/or the main body 120), and pivot the flap 102 relative to the sidewall 104 to fully open the aperture 128. As shown in FIGS. 10 and 11, the tab 122 may be folded outwardly relative to the main body 120 of the flap 102, such that a user may grasp a portion of the flap 102 (such as the tab 122 and/or the main body 120) and pivot the flap 102 relative to the sidewall 104. When folded inwardly (see, e.g., FIGS. 5-7), the tab 122 may be folded back onto the main body 120 of the flap 102 such that the tab 122 extends along a rear surface 125 of the main body 120 (see, e.g., FIG. 6). Although illustrated in FIG. 6 as being spaced inwardly of the main body 120, the tab 122 may be positioned against the rear surface 125 of the main body 120 depending on the user's preference. When folded outwardly (see, e.g., FIGS. 10 and 11), the tab 122 may extend at an angle, such as generally perpendicular, to the main body 120 of the flap 102 (see, e.g., FIG. 11). Alternatively, the tab 122 may extend along a front surface of the main body 120 (e.g., the tab 122 may be positioned against the front surface of the main body 120) depending on the user's preference. The second living hinge 124 may be scored to facilitate pivoting of the tab 122 relative to the main body 120 of the flap 102.

Referring to FIG. 3, the main body 120 of the flap 102 may be larger in area than the tab 122. In some embodiments, the main body 120 and the tab 122 may have the same height, but the main body 120 may be longer than the tab 122. For example, as illustrated in FIG. 3 the main body 120 of the flap 102 may correspond in length to the length $L_H$ of the first living hinge 108 and may correspond in height to the height $H_F$ of the flap 102. As further illustrated in FIG. 3, the tab 122 may correspond in length to the length $L_T$ of the end portion 110 of the bottom edge 106*d* and may correspond in height to the height $H_F$ of the flap 102.

The tab 122 may be formed in various shapes, sizes, and orientations relative to the main body 120 of the flap 102. In FIGS. 3-7, 10, and 11, the tab 122 is illustrated as being formed along a left end of the main body 120 of the flap 102. However, in some embodiments the tab 122 may be formed along a right end of the main body 120, opposite that shown in FIGS. 3-7, 10, and 11. In some embodiments, the tab 122 may be formed along an edge portion of the flap 102 opposite the first living hinge 108 such that the tab 122 and the main body 120 each correspond in length to the length $L_F$ of the flap 102, and the aggregate height of the main body 120 and the tab 122 corresponds to the height $H_F$ of the flap 102. In some embodiments, a corner of the flap 102 (such as at the intersection of the edges 106*a* and 106*c* and/or the edges 106*b* and 106*c*, see FIG. 3) may be folded relative to a remaining portion of the flap 102 to form a tab. In some embodiments, the flap 102 may include more than one tab, and the one or more tabs may be formed on any one edge 106*a*-106*d* or combination of edges. Other shapes, sizes, and orientations of the tab 122 are contemplated.

Referring to FIG. 3, the second living hinge 124 may extend at an angle relative to the first living hinge 108. The angle between the first and second hinges 108, 124 may be acute, obtuse, or substantially a right angle depending on the particular application. The angle between the first and second living hinges 108, 124 may determine at least in part the size of the tab 122. As illustrated in FIG. 3, the second living hinge 124 may extend perpendicular to the first living hinge 108 and may intersect an end 108*a* of the first living hinge 108 such that the tab 122 forms a terminal end portion of the flap 102. Other arrangements of the first and second living hinges 108, 124 are contemplated.

Figure 7:
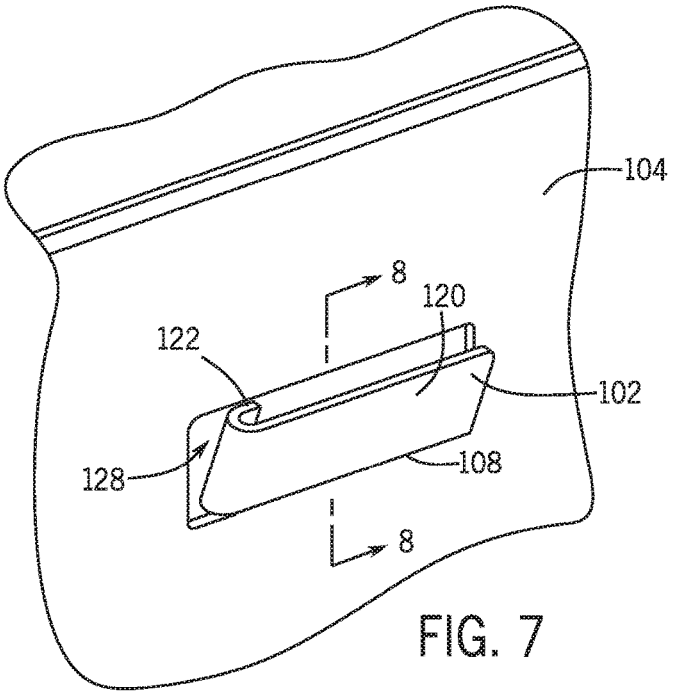
FIG. 7 is a fragmentary isometric view of the box of FIG. 5 with the flap pivoted outwardly away from the sidewall of the box.
Figure 8:
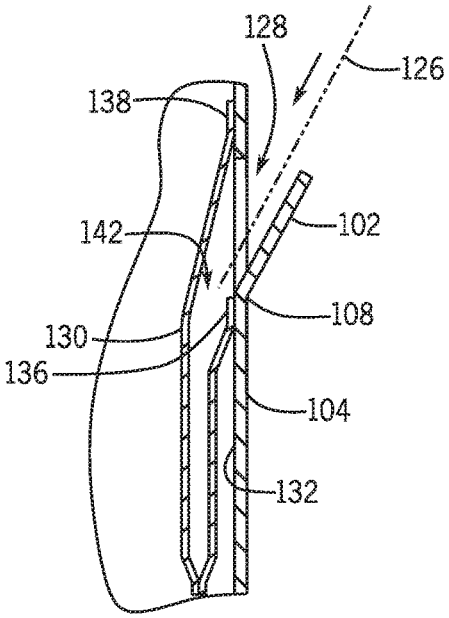
FIG. 8 is a sectional view of the box illustrated in FIG. 7 taken along line 8-8 in FIG. 7 with a sleeve associated with the flap for receiving one or more documents (e.g., product manuals, shipping information, etc.), components (e.g., spare parts, batteries, etc.), and/or other items.
Figure 9:
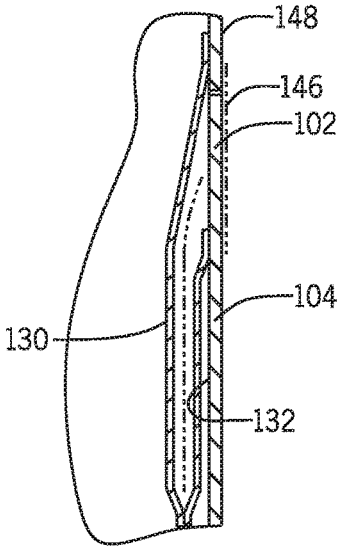
FIG. 9 is a sectional view of the box similar to FIG. 8 but with the flap positioned in plane with the sidewall of the box.

Referring to FIGS. 5-8, 10, and 11, the tab 122 may facilitate a user in pivoting the flap 102 relative to the sidewall 104 to open the aperture 128 and provide the user access into an interior of the box 100. Referring to FIG. 8, one or more items 126 (such as documents, components, and/or other items) may be inserted through the aperture 128 formed in the sidewall 104 when the flap 102 is at least partially positioned out-of-plane with the sidewall 104. For example, as illustrated in FIG. 8, one or more items 126 may be inserted through the aperture 128 into the interior of the box 100 when the flap 102 is positioned out-of-plane with the sidewall 104. The one or more items 126 may be dropped into the interior of the box 100. Referring to FIG. 9, after the one or more items 126 are inserted into the interior of the box 100, the flap 102 may be pivoted back in plane with the sidewall 104 to close the aperture 128, thereby retaining the one or more items 126 inside the box 100.

Referring to FIGS. 8 and 9, a sleeve 130 may be attached to an inner surface 132 of the sidewall 104 for receiving the one or more items. The sleeve 130 may be attached to the sidewall 104 adjacent the edges 106 of the flap 102 to provide access to the one or more items 126 through the aperture 128. As illustrated in FIG. 8, the sleeve 130 may be attached to the sidewall 104 below the aperture 128 along a first end portion 136 and to the sidewall 104 above the aperture 128 along a second end portion 138 such that the sleeve 130 substantially surrounds the aperture 128 along the inner surface 132 of the sidewall 104. The sleeve 130 may define a pocket 142 for receiving the one or more items, and the pocket 142 may facilitate retrieval of the items from the box 100 if needed.

Referring to FIG. 9, the flap 102 may be secured in plane with the sidewall 104 with a securement element 146, such as a strip of tape, to ensure the flap 102 remains in a closed position in which the flap 102 occupies the space defined by the aperture 128 (see, e.g., FIGS. 1-4, 12, and 13) during shipping. The securement element 146 may be attached to an outer surface 148 of the sidewall 104. As illustrated in FIG. 9, the securement element 146 may cover the flap 102 to secure the flap 102 in plane with the sidewall 104 and ensure the flap 102 is not dislodged during transport.

Figure 4:
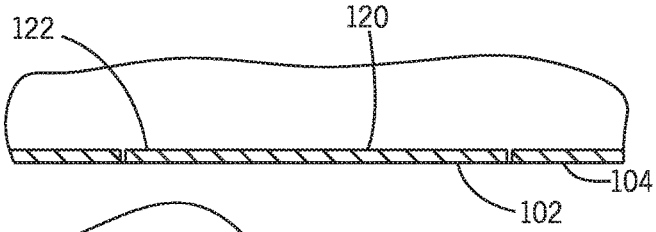
FIG. 4 is a sectional view of the box illustrated in FIG. 1 taken along line 4-4 in FIG. 3.

Operation of the flap 102 will now be discussed in more detail with reference to FIGS. 1-14. Referring to FIGS. 1-4, the flap 102 may be positioned initially in the same plane as the sidewall 104. As illustrated in FIGS. 3 and 4, the main body 120 and the tab 122 may be coplanar when the flap 102 closes the aperture 128. Referring to FIGS. 7, 8, 10, and 11, the flap 102 may be pivoted relative to the sidewall 104 to expose the aperture 128 formed in the sidewall 104 and provide access to the interior of the box 100. The flap 102 may be pivoted about the first living hinge 108 formed in the sidewall 104 from a closed position in which the flap 102 is in plane with the sidewall 104 (see, e.g., FIGS. 1-4, 12, and 13) either outwardly away from the sidewall 104 (see, e.g., FIGS. 7 and 8) or inwardly into an interior of the box 100 (see, e.g., FIGS. 10, 11, and 14).

Referring to FIGS. 10 and 11, a user may pivot the flap 102 into the interior of the box 100 to open the aperture 128. To pivot the flap 102 into the interior of the box 100, a user may push inwardly on the flap 102 to displace the flap 102 from the plane of the sidewall 104. The inward force applied to the flap 102 by the user may cause the flap 102 to pivot about the first living hinge 108. Once the flap 102 is pushed inwardly out-of-plane with the sidewall 104, the user may insert one or more items 126 (see, e.g., FIG. 8), such as documents (e.g., product manuals, shipping information, etc.), components (e.g., spare parts, batteries, etc.), and/or other items into the interior of the box 100. Then, the user may reposition the flap 102 back to a position in which the flap 102 is coplanar with the sidewall 104 to close the aperture 128. To reposition the flap 102, the user may grasp at least the tab 122 and then apply a force to the tab 122 to move the flap 102.

To facilitate grasping of the flap 102, the user may pivot the tab 122 about the second living hinge 124 formed in the flap 102 (see FIGS. 3, 5, and 10) relative to the main body 120 of the flap 102. For example, the user may pivot the tab 122 about the second living hinge 124 from a first position in which the tab 122 is coplanar with the main body 120 of the flap 102 (see, e.g., FIGS. 3 and 4) into a second position in which the tab 122 is non-planar with the main body 120 (see, e.g., FIGS. 7, 8, 10, 11, and 14).

In the second position, the tab 122 may be folded inwardly or outwardly relative to the main body 120. Referring to FIGS. 4-6, the user may push inwardly on the tab 122 to displace the tab 122 from the plane of the main body 120 of the flap 102. The inward force applied to the tab 122 by the user may cause the tab 122 to pivot about the second living hinge 124. Once the tab 122 is pushed inwardly out-of-plane with the sidewall 104, the user may insert a portion of their hand (e.g., one or more fingers) through the portion of the aperture 128 vacated by the tab 122 and grasp the flap 102 (e.g. the tab 122 and/or the main body 120). The user may press the tab 122 against the rear surface 125 of the main body 120 of the flap 102, if desired. The user may then pivot the flap 102 inwardly or outwardly relative to the sidewall 104 to fully open the aperture 128. For example, as illustrated in FIG. 7, the user may pull on the flap 102 by applying an outwardly-directed force on the tab 122 and/or main body 120 to pivot the flap 102 outwardly relative to the sidewall 104. The user may insert one or more items 126, such as documents (e.g., product manuals, shipping information, etc.), components (e.g., spare parts, batteries, etc.), and/or other items into the interior of the box 100.

Referring to FIGS. 10 and 11, the tab 122 may be folded outwardly relative to the main body 120 such that a user may grasp the tab 122 when the flap 102 is pivoted, for example, into an interior of the box 100 (see, e.g., FIGS. 10 and 11). As illustrated in FIG. 10, the tab 122 may be accessible from outside the box 100 when the flap 102 is pivoted inwardly into the box 100 such that the user may easily grasp the tab 122 to reposition the flap 102 once the one or more items 126, such as documents (e.g., product manuals, shipping information, etc.), components (e.g., spare parts, batteries, etc.), and/or other items are inserted into the box 100. Alternatively, the user may pull on the outwardly-folded tab 122 to pivot the flap 102 outwardly away from the sidewall 104. The tab 122 may be scored or pre-formed with a crease or fold line to facilitate pivoting of the tab 122 relative to the main body 120 of the flap 102.

Figure 12:
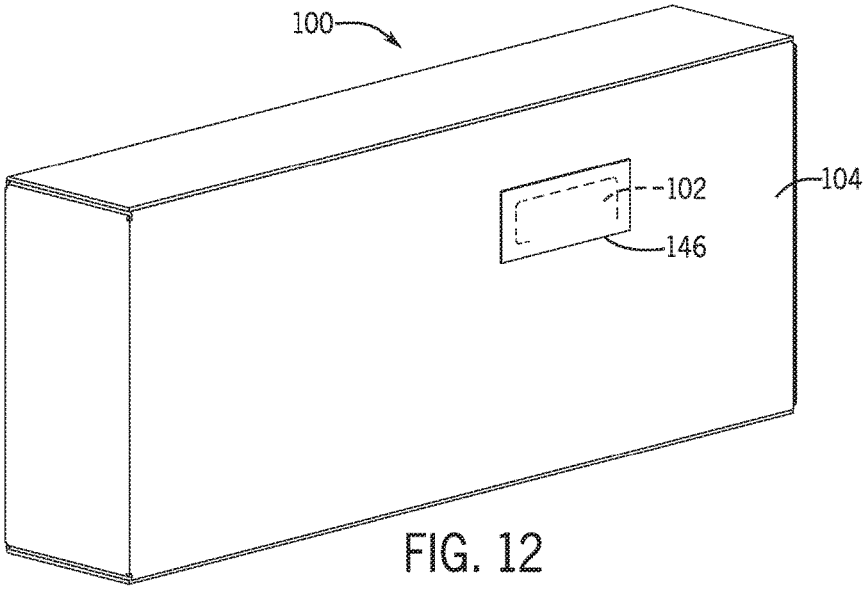
FIG. 12 is a top isometric view of the box of FIG. 1 with a securement element, such as a strip of tape, securing the flap in plane with the sidewall of the box.

Referring to FIGS. 4, 9, and 12, after the one or more one or more items 126 are inserted into the box 100, the user may position the flap 102 in a planar orientation with the sidewall 104 and secure the flap 102 in the planar orientation. To form the planar flap, the user may pivot the tab 122 (see FIGS. 5-7, 10, and 11) relative to the main body 120 of the flap 102 such that the tab 122 and the main body 120 are coplanar, and the user may secure the planar flap 102 to the sidewall 104 to close the aperture 128. The tab 122 may be pivoted relative to the main body 120 of the flap 102 before or after the main body 120 is moved to a position in which the main body 120 is coplanar with the sidewall 104. The flap 102 may frictionally engage the sidewall 104 (such as by interference fit) to limit movement of the flap 102 relative to the sidewall 104. Additionally or alternatively, as illustrated in FIGS. 9 and 12, the user may secure the flap 102 in plane with the sidewall 104 via a securement element 146, such as a strip of tape. The user may position the securement element 146 over the flap 102 and attach the securement element 146 to the sidewall 104 such that the securement element 146 covers the entire flap 102 to maintain the flap 102 in the planar orientation and restrict ingress of debris into the box 100 during transport.

Referring to FIGS. 13 and 14, the box 100 may be used to package fitness equipment for transport. For example, as illustrated in FIGS. 13 and 14, the box 100 may package a recumbent bike 154, which may be separated into components or sub-assemblies to minimize the size of the box 100. The recumbent bike 154 may be supported within the box by packaging materials 156, such as foam blocks. Referring still to FIGS. 13 and 14, the flap 102 may be formed in any of the sidewalls 104, and the location of the flap 102 may depend on the contents of the box 100 and the particular arrangement of the contents within the box 100. For example, the flap 102 may be defined in the sidewall 104 at a location that corresponds to an empty space or void inside the box 100 such that one or more documents (e.g., product manuals, shipping information, etc.), components (e.g., spare parts, batteries, etc.), and/or other items may be inserted into the box 100 after the product is packaged for shipping. The one or more items may be dropped into the box 100, or may be placed inside a sleeve attached to the sidewall 104 inside the box 100. As previously discussed, after the one or more items are inserted into the box 100, the flap 102 may be repositioned to a coplanar relationship with the sidewall 104 to close the aperture 128 in the sidewall 104. The flap 102 may be held in this closed position by the securement element 146 (see FIGS. 9 and 12).

Referring back to FIGS. 1-14, the flap 102 may be formed in a sidewall 104 of a box 100. The first living hinge 108 may be formed along a bottom edge 106*d* of the flap 102, and the periphery 114 of the flap 102 may be separated from the sidewall 104 to permit pivotal movement of the flap 102 about the first living hinge 108 relative to the sidewall 104. An end portion 110 of the bottom edge 106*d* may be separated from the sidewall 104 similar to the rest of the periphery 114 to form the tab 122 in the flap 102. The tab 122 may pivot about the second living hinge 124 for grasping by the user to move the flap 102 relative to the sidewall 104. The user may push the flap 102 into an interior of the box 100 or the user may pull the flap 102 outwardly away from the sidewall 104 to provide access to the interior of the box 100 through the aperture 128 formed in the sidewall 104 that the flap 102 occupies when positioned in plane with the sidewall 104. Once the flap 102 is pivoted out-of-plane relative to the sidewall 104, the user may deposit one or more items 126, such as documents (e.g., product manuals, shipping information, etc.), components (e.g., spare parts, batteries, etc.), and/or other items into the interior of the box 100 through the aperture 128. To close the aperture 128, the user may grasp the tab 122 and push or pull the flap 102 back into a closed position in which the flap 102 is coplanar with the sidewall 104. The flap 102 may be secured in its closed position, such as with tape, to seal the aperture 128.

The box 100 may be formed from a variety of materials. For example, the box 100 may be formed from metal, plastic, cardboard, or any other suitable material with sufficient strength to ship the product, such as fitness equipment. In some embodiments, the box 100 may be reinforced to provide additional strength.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A box, comprising:

a sidewall; and a flap formed in the sidewall and repositionable relative to the sidewall to selectively open and close an aperture formed in the sidewall, the flap including a main body and a tab, the tab repositionable relative to the main body of the flap for grasping by a user;

wherein:

the flap is pivotable about a first living hinge formed in the sidewall;

the tab is pivotable about a second living hinge formed in the flap;

the second living hinge intersects the first living hinge; and a dimension of the tab in a direction perpendicular to the second living hinge in a plane defined by the intersection of the first and second living hinges is smaller than a dimension of the main body in a direction perpendicular to the first living hinge in the plane; the box further comprising:

a sleeve attached to an inner surface of the sidewall, wherein a first end portion of the sleeve is attached to the inner surface of the sidewall below the aperture and a second end portion of the sleeve is attached to the inner surface of the sidewall above the aperture such that the sleeve substantially surrounds the aperture along the inner surface of the sidewall and is thereby configured to contain an item in proximity to the aperture such that the item is accessible through the aperture.

2. The box of claim 1, wherein:

the first living hinge extends along an edge of the flap; and the edge has a longer length than the first living hinge.

3. The box of claim 2, wherein an end portion of the edge is separated from the sidewall.

4. The box of claim 2, wherein the edge comprises a bottom edge of the flap.

5. The box of claim 1, wherein the first living hinge is scored to facilitate pivoting of the flap relative to the sidewall.

6. The box of claim 1, wherein the second living hinge is positioned between the tab and the main body of the flap.

7. The box of claim 1, wherein the second living hinge intersects an end of the first living hinge.

8. The box of claim 1, wherein the second living hinge extends perpendicular to the first living hinge.

9. The box of claim 1, wherein the second living hinge is scored to facilitate pivoting of the tab relative to the main body of the flap.

10. The box of claim 1, wherein the tab comprises an end portion of the flap.

11. The box claim 1, wherein the flap is pivotable relative the sidewall between a first position in which the flap is coplanar with the sidewall and a second position in which the flap is non-planar with the sidewall.

12. The box of claim 1, wherein the tab is pivotable relative the main body of the flap between a first position in which the tab is coplanar with the main body and a second position in which the tab is non-planar with the main body.

13. The box of claim 1, further comprising a securement element attached to an outer surface of the sidewall and the flap when the aperture is closed by the flap to secure the flap in a planar orientation with the sidewall.

14. The box of claim 1, wherein the main body of the flap is larger in area than the tab.

15. The box of claim 1, wherein the first living hinge and the second living hinge are positioned interiorly of a periphery of the sidewall.

16. A method of accessing an interior of a box, the method comprising:

pivoting a flap formed in a sidewall of the box relative to the sidewall to provide access to an aperture formed in the sidewall, wherein the flap is attached to the sidewall via a first living hinge, and wherein the box further comprises a sleeve having a first end portion attached to an inner surface of the sidewall below the aperture and a second end portion attached to the inner surface of the sidewall above the aperture such that the sleeve substantially surrounds the aperture, the sleeve defining a pocket configured to hold an item in proximity to the aperture;

pivoting a tab of the flap relative to a main body of the flap, wherein the tab is attached to the main body via a second living hinge, which intersects the first living hinge; and grasping the tab to reposition the flap relative to the sidewall;

wherein:

pivoting the flap comprises pivoting the flap about the first living hinge; and pivoting the tab comprising pivoting the tab about the second living hinge.

17. The method of claim 16, further comprising inserting one or more items into the sleeve through the aperture.

18. The method of claim 16, further comprising:

positioning the flap in a planar orientation with the sidewall; and securing the flap in the planar orientation.

19. The method of claim 16, wherein the second living hinge extends perpendicular to the first living hinge.

20. A box, comprising:

a sidewall;

a flap formed in the sidewall and repositionable relative to the sidewall to selectively open and close an aperture formed in the sidewall, the flap including a main body and a tab, the tab repositionable relative to the main body of the flap for grasping by a user;

wherein:

the flap is pivotable about a first living hinge formed in the sidewall;

the tab is pivotable about a second living hinge formed in the flap; and the second living hinge extends perpendicular to the first living hinge; and a sleeve attached to an inner surface of the sidewall and configured to contain an item in proximity to the aperture such that the item is accessible through the aperture, wherein the sleeve comprises a first end portion attached to the sidewall below the aperture and a second end portion attached to the sidewall above the aperture such that the sleeve substantially surrounds the aperture along the inner surface of the sidewall.

* * * * *